United States Patent [19]

O'Hare

[11] Patent Number: 4,508,493

[45] Date of Patent: Apr. 2, 1985

[54] SELF ACTUATING DIAPHRAGM PUMP

[76] Inventor: Louis R. O'Hare, 1700 Banyan #3, Fort Collins, Colo. 80526

[21] Appl. No.: 476,024

[22] Filed: Feb. 28, 1983

[51] Int. Cl.[3] ..... F04B 17/00

[52] U.S. Cl. ..... 417/379; 60/641.15

[58] Field of Search ..... 417/379, 395; 60/531, 60/514, 641.15, 669

[56] References Cited

U.S. PATENT DOCUMENTS

| | | | |
|---|---|---|---|
| 684,379 | 10/1901 | Rayner | 417/379 |
| 4,177,019 | 12/1979 | Chadwick | 417/379 |
| 4,207,034 | 6/1980 | Zelmer | 417/379 |

*Primary Examiner*—Leonard E. Smith

[57] ABSTRACT

This pump operates by repeatedly forcing water alternately first through a heater and later through a cooler in such a way that a stream of heated water arrives at a pressurization chamber in the form of steam during one time period and a succeeding stream of cooled water arrives at the chamber in an alternate time period, thereby producing alternate pressurizations and depressurizations within the chamber, and the pressure alternations are transmitted to an adjacent pumping chamber by means of a diaphragm separating the two chambers. During the low pressure period in the pumping chamber, water is drawn in through an inlet check valve and during the high pressure period it is expelled through an exit check valve, and the energy to drive the alternating water streams is derived from the pressurizing steam forcing water into an air chamber compressing air so that in a subsequent period the compressed air forces water through the heater and then the cooler.

10 Claims, 5 Drawing Figures

SELF ACTUATING DIAPHRAGM PUMP

This invention is a diaphragm pump which resembles many other diaphragm pumps in that it uses a diaphragm to expand and contract the volume of a cavity. Fluid is drawn into the cavity during the expansion period by means of an inlet check valve and expelled from the cavity through an exit check valve during the contraction period. However, this invention is different from many diaphragm pumps in that it is self-actuating and thereby provides its own means of diaphragm expansion and contraction. For instance, it does not rely on a compressed air source with an air compressor to provide the energy to drive the diaphragm into the cavity. It does not require a cam nor crankshaft driven connecting rod to force the diaphragm into the contracting cavity. In this present invention the diaphragm pumping mechanism is part of an integrated thermodynamic engine which converts heat energy to pumping energy.

This present diaphragm pump is very much like the former diaphragm pump of my copending patent application called, "Solar Diaphragm Pump" except that in this present invention the requirement for a small auxiliary pump is removed. This present invention provides an advantageous simplification of pumping water by means of a diaphragm because it reduces the cost of construction and because it lowers the level of technology required for producing the various operating parts. Since the pump of this present invention does not require any motor driven exciter pump, it may be constructed whereever tanks, valves, and a flexible membrane are available. Accordingly, this present invention provides a pump of increased utility for developing countries in that it is ideally adapted to the use of solar energy while it uses simply constructed components. Besides simplicity of operation, this invention also has a principal object of providing a solar steam pump without the use of a boiler. In it the conversion of water to steam is accomplished merely by ducting that extends through a solar heated thermal mass. This enables high temperatures to be made readily available to produce steam and to do some pumping even during brief periods of solar radiation. Since energy is stored in a small thermal mass rather than in the form of pressure and a large thermal mass, such as is the case with a boiler, this present invention utilizes some of the art of my copending applications in that it too obviates the requirement of using a boiler. These copending applications include on called, "Solar Water Pump" having the Ser. No. 101,218, now U.S. Pat. No. 4,309,148 and a patent application called, "A Solar Displacement Pump". Still this present invention improves upon the inventions of those applications since they are displacement pumps and have inherent inefficiencies which it is the object of this present invention to correct. In that former art the condensation of steam in contact with the water being driven from the displacement chamber removes energy from the steam, which energy might otherwise be of additional assistance for impelling the water. Accordingly, an object of this present invention is to provide another boilerless solar water pump but one with reduced heat loss by providing a diaphragm interface between the steam and the driven water. The advantage of the diaphragm is that it provides crucial insulation between the water and the steam. Yet another object is to provide a closed cycle system wherein the water that is used for steam generation can be continuously reused after being repeatedly condensed. The use of water in this way precludes the formation of scale deposits which impede effective heat transfer. Also the object of providing a self-actuating system means, in one embodiment, that the pump's own internally generated steam both operates the valving and provides the energy for internal water circulation. In another embodiment it means that the energy for internal water circulation is provided by the pump's own steam energy but that the valving is operated electrically. In the former art such as in my copending application, "Solar Water Pump" the necessary internal water circulation to provide the steam to drive a diaphragm is always provided by an exciter pump rather than by available steam pressure.

Clarification of the operating principles as well as other objectives and advantages will be seen by referring to the drawings.

FIG. 1 of the drawings shows a diagram of a self-actuating diaphragm pump with its concentrating solar collector attached.

Figure 1:
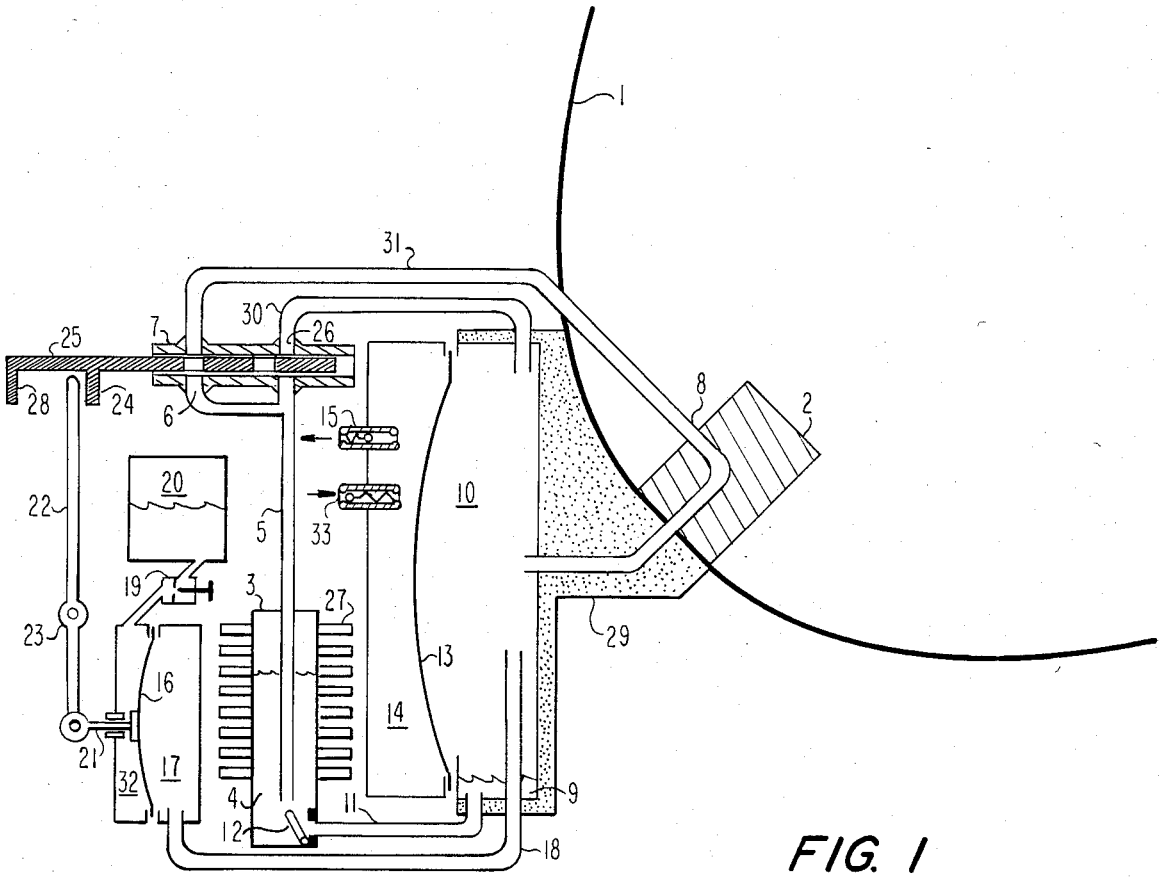

Referring then to FIG. 1 of the drawings, the concentrating solar collector 1 focuses solar radiation on light absorbent thermal mass 2 heating it to fluid vaporization temperatures. Pressurized fluid tank 3 uses air above the level of the fluid 4 to drive any volatile fluid such as water through duct 5 and channel 6 of valve 7 to heat transfer duct 8 in which it is heated by conduction from 2 and thereby converted to a vapor such as steam. The steam or other vapor then accomplishes two functions. First is expells any condensed liquid 9 at the bottom of pressurization chamber 10 thereby driving it through duct 11 and into 3 through check valve 12 thereby increasing the pressure within 4 as the added liquid compresses the air at the top of 3 until the pressure in 3 and that of 10 are approximately equal. The second and principal function of the steam pressure within 10 at this time is to drive diaphragm 13 into pumping chamber 14 thereby driving water or other fluid from 14 through exit check valve 15. While 13 is being driven into 14, diaphragm 16 of small pressure chamber 17 is being driven by steam through duct 18 so that 16 is extended into metering chamber 18. The fluid in 18 is driven at a controllable rate through control valve 19 into reservoir 20. The fluid exit rate from 18 to 20 is adjusted by 19 to mimic the fluid exit rate from 14 so that the maximum deflection of 16 into 18 will approximately coincide with maximum deflection of 13 into 14. Control valve 19 may even be set to allow 16 to reach its maximum deflection into 18 before 13 reaches its maximum deflection into 14 because any deflection of 13 will result in fluid being pumped from 14. Near the end of the travel of 16 to the left, the connecting shaft to 16, which is 21, rotates linkage lever 22 to the point at which it finally engages cog 24 on valve rod 25. This engagement slides 25 to the right changing the condition of valve 7 thereby closing off channel 6 to stop the generation of steam or other vapor in 10. The linkage lever 22 rotates on pivot 23 to effect the movement of 22 against 24. The changing of the condition of 7 opens channel 26 admitting cooled fluid to 10 from 3. Fluid 4 is cooled by fins 27 attached to 3. As the cooled fluid enters 10 it condenses the vapor in 10 creating a low pressure in 10 which closes check valve 12 and contracts both 13 and 16. As the low pressure contracts 16 from its extended position into 14 the volume of 14 increases drawing in water or other fluid through inlet check valve 27. The low pressure in 10 similarily draws 16 into 17 moving the top of 22 to the left until, near the end of the deflection of 13 and 16 to the right, linkage lever 22 finally contacts cog 28 to move 25 again to the left to close 26 and open 6. During the low pressure part of the cycle, the liquid from 20 is drawn back through 19 and into metering chamber 18 at a rate controlled by 19 so that both 13 and 16 will reach the points of their maximum deflections to the right at approximately the same time. Since thermal mass 2 has been heating even during the low pressure period of the cycle and since the heat loss is being constrained by insulation 29, when 28 is moved to the left opening 6, fluid 4 is again delivered to heat transfer duct 8 for another period of steam generation and pressurization of 10. The quantity of water or liquid that is used both for the generation of steam as well as for cooling and condensing the steam is controlled by the size of duct 5 in this embodiment. In another embodiment a valve is inserted in duct 31 to control the flow through 31 and regulate the amount of steam generated in 8. Similarly, in another embodiment a valve is placed in cooling duct 30 to regulate the flow of cool water to 10. These two valves are not shown in the drawing for the sake of drawing simplicity and clarity and because the use of valving for regulation is well understood in the art.

Figure 2:
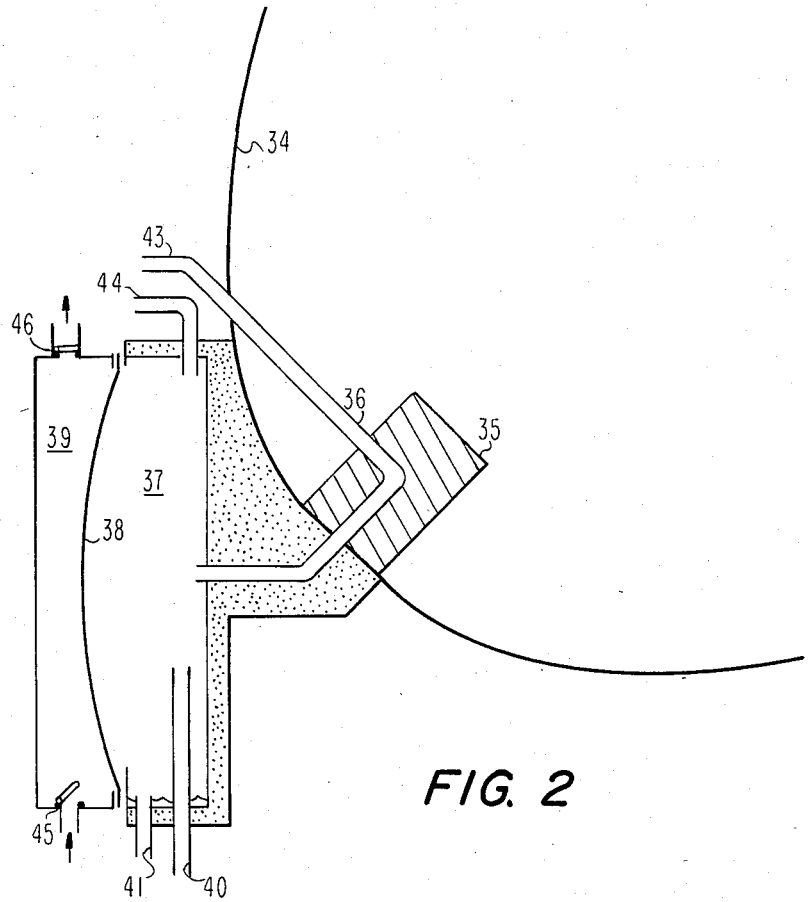
FIG. 2 shows a concentrating collector with pump to which various actuating mechanisms can be added.

Referring then to FIG. 2 of the drawings, the concentration solar collector 34 is the same as collector 1 of FIG. 1. Likewise in this FIG. 2, the thermal mass 35 is the same as 2 of FIG. 1. Similarily heat transfer duct 36 is the same as 8 of FIG. 1. Pressurization chamber 37 and diaphragm 38 are the same as 10 and 13 of FIG. 1 respectively. The pumping chamber 39 in this FIG. 2 is the same as 14 of FIG. 1. In this FIG. 2, the pressure transfer line 40 is like line 18 of FIG. 1 except that 40 is used to transfer steam pressure or other vapor pressure to a more remote small pressure chamber which will be shown in the following FIG. 3. The same is true of duct 41 of FIG. 2 in that it too is used to conduct steam-pressurized fluid to a more remote location, but in the case of this duct 41 it transfers condensed water or other liquid to a remote pressurized liquid tank like tank 3 of FIG. 1. The only difference between 41 of FIG. 2 and 11 of FIG. 1 is that 41 is longer and provides for the romote operation of a pressurized fluid tank which will be shown in the following FIG. 3. In FIG. 2 line 40 and duct 41 are both flexible insulated lines as are lines 43 and 44 because they each transfer fluid to a remote component in a remote unit to be shown in FIG. 3. Water-for-steam transfer duct 43 functions the same as 31 of FIG. 1 except that 43 in FIG. 2 is longer. Water-for-cooling transfer duct 44 has the same function as 30 of FIG. 1 except that 44 is longer to permit a remote location of a valve like the valve 7 of FIG. 1. The valve to which 43 and 44 are connected is shown in the following FIG. 3 which follows. In FIG. 2 water or other fluid admitted through 43 is converted to vapor in 36 by the action of heat in 35 and the vapor pressure in 37 drives 38 into 39 driving fluid from exit check valve 46. The cessation of flow in 43 and the actuation of cool liquid flow in 44 condenses vapor in 37, reducing pressure in 37, retracting 38 from 39 and drawing in water or other fluid through inlet check valve 45. The object of providing long coupling lines 40, 41, 43 and 44 is to enable the collector and pump to be pivoted independently of the valving and valve control mechanisms. In this way conventional tracking mechanisms, not shown because they are well understood in the art, can be used to follow the sun with the collector without moving all of the pump's components.

Figure 3:
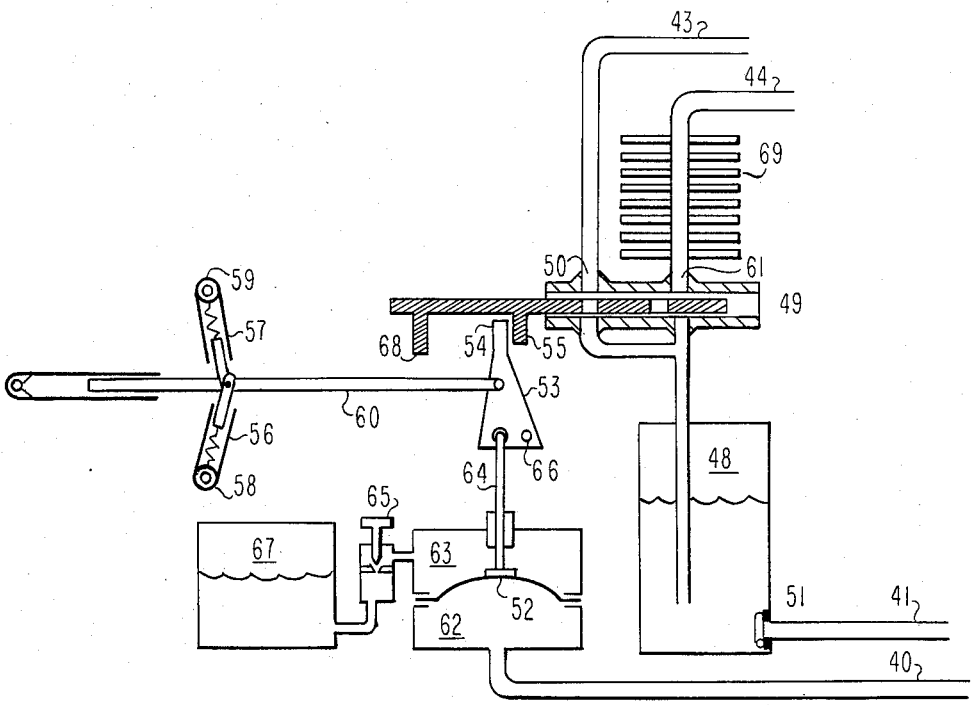
FIG. 3 shows one of the pump's self actuating mechanisms with a toggle joint to provide positive valve action.

Referring then to FIG. 3, the flexible lines 40, 41, 43 and 44 are the same lines and ducts as those with the same numbers in FIG. 2. That is to say in this FIG. 3 the line 40 is merely an extension of pressure transfer line 40 of FIG. 2. and so on. Pressure during a steam or other vapor generation period taking place in 37 of FIG. 2 drives water or other liquid to liquid pressure tank 48 of this FIG. 3 through line 41. The pressure in 48 moves water or other volatile liquid through valve 49 and valve channel 50 until the pressures in 48 and 37 are approximately equal. When they are equal, check valve 51 closes and the pressure in line 40 fully deflects metering diaphragm 52 upward, pivoting bell crank 53 clockwise until its upper cog 54 engages cog 55. At approximately the time this engagement is made the spring-loaded toggles 56 and 57, supported on fixed bearings 58 and 59, are forced to their over-center positions by the movement of link 60 to the right. The springs in the spring loaded toggles then expand to suddenly assist 53 in its clockwise rotation by moving 60 to the right and this causes 54 to rapidly move 55 to the right thereby closing channel 50 and opening channel 61. The water flow through 43 that produced steam in 36 is stopped and in its place water is conducted through 44 to cause cooling in 37 of FIG. 2 and, with the cooling, a low pressure is developed there. The low pressure is transmitted by 40 to metering chamber 62 of this FIG. 3 and the diaphragm 52 is retracted from chamber 63. Then the diaphragm connecting link 64 moves downward rotating 53 on pivot 66 in a counterclockwise direction. The rate of rotation is controlled by metering valve 65 since it controls the rate of fluid flow from reservoir 67 to 63 and this rate in turn controls the rate of downward deflection of 52. The deflection rate of 52 is made to coincide with the deflection rate of diaphragm 38 of FIG. 2 as it is withdrawn from chamber 39. When 52 reaches a point in its downward deflection that is close to its maximum deflection point, 56 and 57 are forced to their over-center positions. Farther downward deflection of 52 drives 60 farther to the left and 56 and 57 are moved off of their over-center positions, in which condition they assist in suddenly moving link 60 rapidly to the left causing 54 to contact cog 68, moving it to the left to again open 50 and close 61. The guide 68 helps restrain 60 in its horizontal movement. By repeatedly changing the liquid flows from moving first in 43 and then in 44, pressure alternations are provided against diaphragm 38 of FIG. 2 for the purpose of pumping fluid with chamber 39. The components of this FIG. 3 are used as one unit to form a two unit pump when joined with the components of FIG. 2. The cooler 69 removes heat from the circulating liquid that is used to condense steam in pressurization chamber 37 of FIG. 2.

Figure 4:
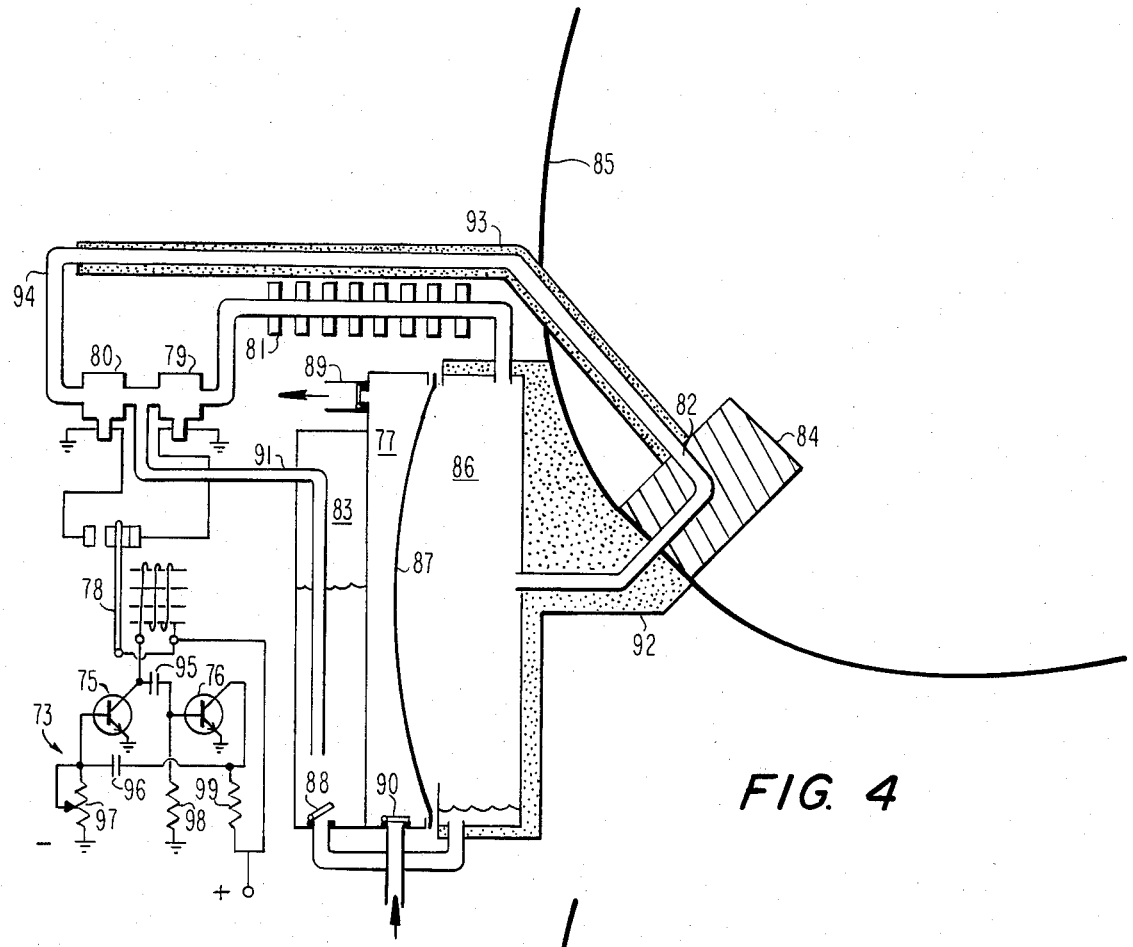
FIG. 4 shows an electric oscillator for electric valve actuation.

Referring then to FIG. 4 of the drawings, electric valves 71 and 72 are alternately opened and closed by an electric oscillator 73. In this way when 71 is open 72 is closed and when 72 is open 71 is closed. The timing of the opening and closing is accomplished by adjusting the frequency of the oscillator. The frequency in turn is determined by the proper selection of the resistance values of the base and collector resistors as well as by the capacitance of the base to collector capacitors of the oscillator. The values of these resistors and capacitors are chosen to provide that frequency which will cause an emitter to collector conduction current in the relay control transistor 75 which will continue for a time period which is approximately as long as the time required to draw water into the pumping chamber 77. Since the oscillator shown in an astable multivibrator, first transistor 75 will conduct then 76 will conduct and 75 will not conduct while 76 is conducting. Likewise 76 will not conduct while 75 is conducting. Whenever 75 is conducting relay 78 is energized and electric valve 79 is receiving current to stay open. When 75 is not conducting and 80 is not energized then electric valve 80 receives current and stays open while 79 stays off. Water flows through cooler 81 when 79 is open but not when 80 is open. Water flows through heat transfer duct 82 when 80 is open but not when 79 is open. The pressurized water tank 83 provides a source of pressurized water for the alternate flows through 81 and 82. When 80 is open and water or other volatile liquid is flowing through 82, then the heat developed in thermal mass 84 by solar radiation concentrated by collector 85 vaporizes the water producing pressure in pressurization chamber 86 forcing diaphragm 87 into chamber 77 and driving water out through check valve 89. The pressure in 86 at this time also drives condensed water at the base of 86 into 83 placing it under pressure in 83 as it moves through check valve 88. During the alternate period of an oscillation when 79 is open, the steam in 86 is condensed by the cool flow through 81. The vacuum that follows draws 87 into 86 and draws water into 77 through inlet check valve 90. The duct 91 provides water under pressure from 83 to valves 79 and 80. The insulation 92 and 93 prevent heat loss from 86 and from duct 94. Capacitors 95 and 96 are the base to collector capacitors. The resistors 97 and 98 are the base resistors and the collector resistor is 99. The electric power to operate the oscillator and the valves is provided in one embodiment by thermoelectric cells attached to the thermal mass 84 and cooled by the water being pumped from 89. In another embodiment a bank of solar cells is used to provide the electric power requirement. Since relay 78 is of low power and valves 79 and 80 can be made to require very little energy, the electric power source can be reduced to a source with a few watts of output. The check valves 89 and 90 connect to appropriate exit and inlet ducting in the conventional manner in which any ordinary water pump is connected but these connections are not shown because they are beleived to be obvious.

Figure 5:
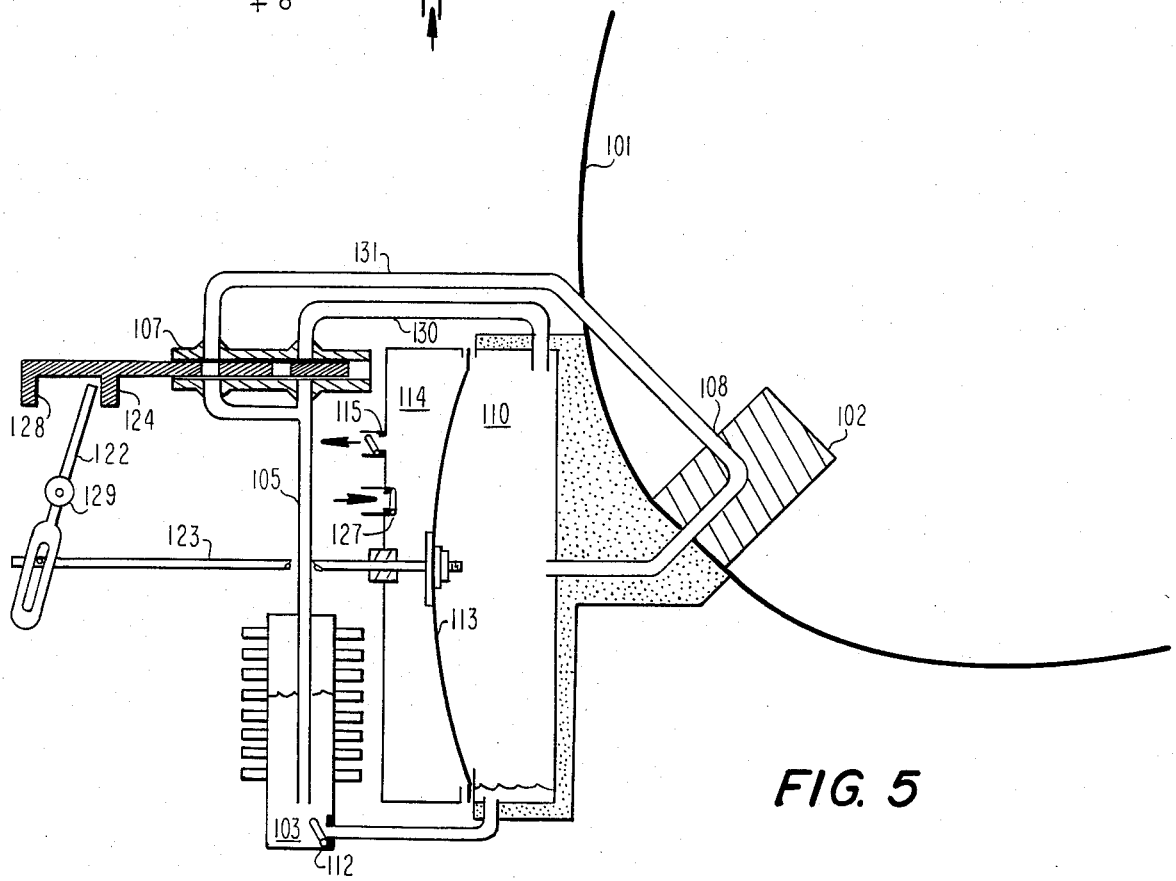
FIG. 5 shows a diagram of the pump's main pumping diaphragm being used to control valving.

Referring to FIG. 5, collector 101 is the same as 1 of FIG. 1. The thermal mass 102 and heat transfer duct 108 are the same as 2 and 8 respectively of FIG. 1. Again in this FIG. 5 the pressurization chamber 110 and pumping chamber 114 serve the same purpose as 10 and 14 of FIG. 1. The same is true of exit and inlet check valves 115 and 127 in that their function is the same as the function of valves 15 and 27 respectively of FIG. 1. In FIG. 5 the cooler 103 with its check valve 112 and its duct 105 all correspond in order to the cooler 3, valve 12 and duct 5 of FIG. 1. Even valve 107 of this FIG. 5 has the same function as valve 7 of FIG. 1. In this FIG. 5 the changing of the condition of 105 is accomplished by control arm 123 attached to diaphragm 113 which rotates link lever 122 to contact cogs 124 and 128 to alternate the condition of 107 providing alternate fluid flow first to duct 131 and then to duct 130 to first provide steam pressure in 110 and then a vacuum in 110. When 113 is driven into 114 by steam produced from water flowing in 108, then water is 114 is expelled through exit check valve 115 and when steam is condensed in 110 by cool water forced from 103 through 107 and 130 into 110, then diaphragm 113 retracts into 110 drawing water into 114 through inlet check valve 129. During the period of maximum contraction of 113 when 123 is near the farthest of its travel to the right, then 122 is rotated on pivot 124 to contact cog 128 and condition 107 to admit water to 108 for steam generation. The subsequent pressurization of 110 moves 123 to the left and 122 to the right. At the end of the travel of 122 to the right it contacts cog 124 moving it to the right and reconditioning 107 to again admit cooling water to 110 for a repeat condensation.

Throughout the drawings the heat source has been shown to be a concentrating solar collector, but it is not intended to limit the inventive concept to the use of this one heat source. Other heat sources are employed in other embodiments. In one embodiment a thermal mass such as thermal mass 2 of FIG. 1 is located in a combustion heater and is strongly heated by combusting fuels such as methane gas from a biogas generator. Then a heat transfer duct such as duct 8 of FIG. 1 conducts volatile fluid such as water through the thermal mass to produce the high vapor pressure to move the diaphragm according to the way it is operated in the various drawings. In another embodiment the combusting fuel is solid fuel such as wood or agricultural and forest residue etc. Also throughout the drawings the heat transfer duct such as duct 8 of FIG. 1 is shown to be a single tube extending through a thermal mass. However, it is not intended to limit the inventive concept to the use of one single tube through any particular thermal mass. In other embodiments tubing with many branches in used and the thermal mass is very heat conductive metal. In other instances high temperature eutectic salts are used. In still other embodiments a combination of conductive metalic fins and eutectic salts are used in the thermal mass to increase both the heat capacity and the heat conduction of the thermal mass. In the same way it is not intended to arbitrarily restrict the inventive concept to a particular type of electric oscillator. While FIG. 4 described a multivibrator type of oscillator for alternating the opening of electric valves, other embodiments use other oscillators such as relaxation oscillators with unijunction transistors or diacs and still others use relays that are toggled with RC time constants. toggled to open and close their contacts after delay periods which are determined by resistance and capacitance of time delay circuits. Further, the pressurized fluid tank such as tank 3 of FIG. 1 and tank 83 of FIG. 4 are the principal means of storing energy from the heated vapor in order to use it subsequently to provide the energy for the internal liquid circulation, but it is not intended to limit the inventive concept to only one form of pressurized liquid storage for providing the internal liquid circulation. In other embodiments other accumulators are used in place of the pressurized air type of accumulator shown as tank 3 of FIG. 1. Some of these are the spring-loaded piston accumulator and the diaphragm accumulator. In these embodiments the pressurized vapor in the pressurization chamber forces the condensed liquid into a chamber and against a piston or against a diaphragm thereby compressing a spring or stretching a diaphragm to store energy. The liquid thereby placed under pressure is subsequently moved through the heater and cooler by the pressure from the spring or from the stretched diaphragm. Just as a variety of energy storage systems are applicable for internal liquid movement so a variety of solar collecting systems are applicable to the basic inventive concept. In one embodiment a fresnel lens is used in place of the parabolic reflector to concentrate solar radiation on the thermal mass. In another embodiment converging reflective plates direct light to a thermal mass located at the convergence of the plates. Parabolic troughs and convex lenses are other means used in other embodiments for concentrating radiant energy.

It is not intended to limit the inventive concept to a single type of cooler such as cooler 69 of FIG. 3 or cooling duct 81 of FIG. 4. In one embodiment the cooling may be accomplished upstream of the valving as is shown by the cooling fins 27 on tank 3 of FIG. 1. In another embodiment a section of a cooling duct is inserted in a water delivery line to be cooled by the water that is being pumped or the cooling duct can be inserted the source from which the water is being pumped. In still another embodiment the cooling duct is placed inside the pumping chamber so that the water being pumped in and out of the chamber circulates around the cooling duct. These cooling means are not shown in the drawings as it is beleived they are well understood in the art of heat exchanging.

I claim:

1. A self actuating diaphragm pump comprising:

(1) A vapor pressure to fluid flow conversion means in the form of multiple enclosed chambers having a common side which is in the form of a diaphragm capable of enlarging the volume of either one of the chambers while contracting the volume of the other by expansion from the direction of the enlarging chamber and extension into the contracting chamber, one of said chambers being a pump chamber with two check valves for receiving and expelling the fluid being pumped and the second of said chambers having multiple inlet and exit ports, one port being capable of admitting heated vapor, another of admitting cool fluid for vapor condensation, and a third of exiting condensed and cooling liquids, and in addition said second chamber being capable of providing pressurization and vacuum conditions, and (2) fluid flow heating and vaporization means in the form of heat transfer ducting extending through strongly heated thermal mass, and (3) fluid flow cooling means in the form of a cooling duct connected to and extending through a cooler, and (4) internal liquid circulation means in the form of a pressurized liquid storage tank capable of receiving liquid under pressure through ducting connected to a liquid exit port at the bottom of said second chamber of the vapor pressure to fluid flow conversion means and of thereby compressing a gas above the liquid level and of subsequently exiting liquid under pressure from below the liquid level in the liquid storage tank through ducting connected to said storage tank below the liquid level thereof and of delivering said liquid under pressure to an (5) alternating fluid flow communication means in the form of valving and ducting capable of providing fluid flow communication between said second chamber of the vapor pressure to fluid flow conversion means, said cooling means and said circulation means in one time period and then between said second chamber of the vapor pressure to fluid flow conversion means, said heating means and said circulation means in an alternate period.

2. A self-actuating diaphragm pump as in claim 1 in which the fluid flow heating means is heat transfer ducting embedded in thermal mass positioned at the focus of a parabolic, concentrating solar collector.

3. A self-actuating diaphragm pump as in claim 1 in which the fluid flow heating and vaporizing means is heat transfer ducting embedded in a thermal mass positioned at the focus of a fresnel lens.

4. A diaphragm pump as in claim 1 in which the fluid flow heating means is heat transfer ducting embedded in a thermal mass that is positioned in a combustion heater.

5. A diaphragm pump as in claim 1 in which the cooling duct of the fluid cooling means is a duct with cooling fins capable of transferring heat to the surrounding air.

6. A diaphragm pump as in claim 1 in which the fluid flow cooling means is a duct submerged in the liquid that is being pumped.

7. A diaphragm pump as in claim 1 in which the valving of the alternating fluid flow communication means has linkage in the form of a connecting rod attached to the diaphragm and a lever capable of contacting said valving to change its condition in the positions of maximum diaphragm deflection by means of cogs attached to said valving.

8. A diaphragm pump as in claim 1 in which the alternating fluid flow communication means is a repeated valve switching means in the form of two electric valves capable of being opened and closed alternately by an electric oscillator which is capable of repeatedly energizing and deenergizing a relay whose contacts complete a circuit to one valve for opening it when the relay is energized and whose contacts complete the circuit to the other valve for closing it when the relay is deenergized.

9. A diaphragm pump as in claim 1 in which the valving of the alternating fluid flow communication means has linkage and a connecting rod attached to a small diaphragm that is fastened to a small chamber which is in fluid flow communication with the second chamber, said small chamber being capable of receiving pressure alternations from said second chamber for deflecting said small diaphragm in unison with the deflections of the principal diaphragm and in which said valving has valve condition changing cogs capable of being periodically contacted for valve condition change at a position of maximum diaphragm deflection by a cog on a bell crank rotated by said connecting rod.

10. A diaphragm pump as in claim 1 in which the alternating fluid flow communication means is a valve switching means in the form of a free running multivibrator, electronic oscillator intermittently energizing a relay the contacts of which alternately complete a circuit first to one then to the other of two electrically operated fluid valves in such a manner as to open one valve while closing the other and then to close the other while opening the one.

* * * * *